US011237496B2

(12) United States Patent
Yagyu

(10) Patent No.: US 11,237,496 B2
(45) Date of Patent: Feb. 1, 2022

(54) TONER FOR DEVELOPING ELECTROSTATIC IMAGES

(71) Applicant: ZEON CORPORATION, Tokyo (JP)

(72) Inventor: Sakyo Yagyu, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/649,359

(22) PCT Filed: Sep. 27, 2018

(86) PCT No.: PCT/JP2018/036014
§ 371 (c)(1),
(2) Date: Mar. 20, 2020

(87) PCT Pub. No.: WO2019/065868
PCT Pub. Date: Apr. 4, 2019

(65) Prior Publication Data

US 2020/0233326 A1 Jul. 23, 2020

(30) Foreign Application Priority Data

Sep. 29, 2017 (JP) ..... JP2017-191683

(51) Int. Cl.
*G03G 9/087* (2006.01)
*G03G 9/097* (2006.01)

(52) U.S. Cl.
CPC ..... *G03G 9/08737* (2013.01); *G03G 9/09733* (2013.01)

(58) Field of Classification Search
CPC ..... G03G 9/09733; G03G 9/08788; G03G 9/08737; G03G 9/08708; G03G 9/08782
See application file for complete search history.

(56) References Cited

U.S. PATENT DOCUMENTS

2013/0059245 A1* 3/2013 Jang ..... G03G 9/0806 430/108.11
2018/0149989 A1 5/2018 Suzuki et al.

FOREIGN PATENT DOCUMENTS

| | | | | |
|---|---|---|---|---|
| JP | 2004-258429 | * | 9/2004 | ..... G03G 9/087 |
| JP | 2004-258429 | A | 9/2004 | |
| JP | 2005-023148 | A | 1/2005 | |
| JP | 2009-122171 | A | 6/2009 | |
| JP | 2010-085841 | A | 4/2010 | |
| JP | 2011-248108 | A | 12/2011 | |
| JP | 2014-35462 | A | 2/2014 | |
| JP | 2016-206454 | A | 12/2016 | |
| JP | 2018-92139 | A | 6/2018 | |

OTHER PUBLICATIONS

Translation of JP 2004-258429.*
Product Data Sheet for Septon HG 252, published Jul. 2015.*
Notification of Transmittal of Translation of the International Preliminary Report on Patentabililty (Form PCT/IB/338) issued in counterpart International Application No. PCT/JP2018/036014 dated Apr. 9, 2020 with Forms PCT/IB/373 and PCT/ISA/237 (11 pages).
https://www.enplanet.com, Sep. 12, 2021.

* cited by examiner

*Primary Examiner* — Peter L Vajda
(74) *Attorney, Agent, or Firm* — Westerman, Hattori, Daniels & Adrian, LLP

(57) ABSTRACT

Provided is a toner which provides excellent balance between high temperature storage stability and low temperature fixability and which is less likely to cause the bleeding out of a release agent even in a long-term, high-temperature condition. Disclosed is a toner for developing electrostatic images, comprising: colored resin particles comprising a binder resin, a colorant and a release agent, and an external additive, wherein the colored resin particles further comprise a styrene-based thermoplastic elastomer, and wherein a content of a fatty acid ester compound having a number average molecular weight (Mn) of 500 or more and less than 2,000 as the release agent, is from 2 parts by mass to 20 parts by mass with respect to 100 parts by mass of the binder resin.

5 Claims, No Drawings

TONER FOR DEVELOPING ELECTROSTATIC IMAGES

TECHNICAL FIELD

The disclosure relates to a toner for developing electrostatic images (hereinafter, it may be simply referred to as "toner") which is used to develop electrostatic latent images in electrophotography, electrostatic recording, electrostatic printing, etc.

BACKGROUND ART

In image forming devices such as an electrophotographic device, an electrostatic recording device and an electrostatic printing device, the following image forming method is widely used and applied to copy machines, printers, facsimile machines, and multifunctional printers: an electrostatic latent image is formed on a photoconductor, and the formed image is developed with a toner, thereby forming a desired image.

In a toner fixing process, generally, a fixing roller is needed to be heated to a temperature of 150° C. or more upon fixing, and it requires large electric power. In recent years, with an increasing demand for an image forming device that consumes less energy and offers high speed printing, there is a demand for a toner that can keep a high fixing rate even at low fixing temperature (i.e., a toner with excellent low-temperature fixability).

As the method for designing the toner that can meet the above demand, for example, methods such as decreasing the glass transition temperature (Tg) of the toner, incorporating a low-melting-point resin and/or a low-molecular-weight resin in the toner, and incorporating a low-softening-point substance (a release agent) with releasability (removability) such as wax in the toner, have been proposed.

However, the toner with excellent low-temperature fixability has the following problem: while a fixing roller temperature can be set to a low temperature to fix the toner, fusion (blocking) of the toner particles is likely to occur when the toner is used in a high temperature condition or is left (stored) for a long period of time, and the storage stability of the toner may decrease.

Accordingly, considering storage stability, which is a characteristic that contradicts low temperature fixability, toner design is required to develop a toner that is provided with improved low-temperature fixability and can reduce power consumption, without impairing storage stability.

For example, Patent Literature 1 discloses a toner for developing electrostatic images, the toner including colored resin particles that contain a styrene-based thermoplastic elastomer and, as a release agent, a fatty acid ester compound having a number average molecular weight (Mn) of 2,000 to 5,000, in which the fatty acid ester compound has a content of 2 to 20 parts by weight with respect to 100 parts by weight of a binder resin. Patent Literature 1 states that since the styrene-based thermoplastic elastomer is used in combination with the fatty acid ester compound, the toner satisfactorily balances storage stability and low temperature fixability and exhibits satisfactory printing durability not only at ordinary temperature but also after a high temperature storage.

Patent Literature 2 discloses a toner including toner particles containing a binder resin and a release agent, wherein the binder resin contains a styrene acrylic resin and a block polymer; the block polymer includes a polyester portion and a vinyl polymer portion; the weight average molecular weight (Mw) of the vinyl polymer portion is 4000 or more and 15000 or less; and the weight average molecular weight (Mw) of the release agent is 1000 or more and 3500 or less. Patent Literature 2 states that the toner suppresses the bleeding out of the release agent and has excellent low-temperature fixability and charge stability.

CITATION LIST

Patent Literatures

Patent Literature 1: Japanese Patent Application Laid-Open (JP-A) No. 2010-85841

Patent Literature 2: JP-A No. 2016-206454

SUMMARY OF INVENTION

Technical Problem

A relatively-low-molecular-weight release agent for toners is known to increase the low temperature fixability of toners. However, if such a relatively-low-molecular-weight release agent is used in the toners of Patent Literatures 1 and 2, the bleeding out of the release agent is expected to easily occur. Especially for the toner of Patent Literature 2, if the low-molecular-weight release agent is used therein, the bleeding out is thought to be less likely to be suppressed, due to low affinity between the release agent and the block polymer having the polyester moiety and the vinyl polymer moiety.

If the toner is stored in a long-term, high-temperature condition, the low-molecular-weight release agent may bleed out of the toner surface, contaminate printing members and, as a result, cause a printing failure.

Meanwhile, a toner containing a relatively-high-molecular-weight release agent has not only the above-described bleeding out problem, but also a possibility that it cannot maintain a balance between high temperature storage stability and low temperature fixability.

An object of the disclosed embodiments is to provide a toner which provides excellent balance between high temperature storage stability and low temperature fixability and which is less likely to cause the bleeding out of the release agent even in a long-term, high-temperature condition.

Solution to Problem

The inventors of the disclosed embodiments found that the above problems can be solved by using a relatively-low-molecular-weight release agent in combination with a specific elastomer.

The toner for developing electrostatic images according to the disclosed embodiments is a toner for developing electrostatic images, comprising:

colored resin particles comprising a binder resin, a colorant and a release agent, and an external additive, wherein the colored resin particles further comprise a styrene-based thermoplastic elastomer, and wherein a content of a fatty acid ester compound having a number average molecular weight (Mn) of 500 or more and less than 2,000 as the release agent, is from 2 parts by mass to 20 parts by mass with respect to 100 parts by mass of the binder resin.

In the disclosed embodiments, a content of the styrene-based thermoplastic elastomer is preferably from 2 parts by mass to 10 parts by mass with respect to 100 parts by mass of the binder resin.

In the disclosed embodiments, a content of a styrene monomer unit contained in the styrene-based thermoplastic elastomer is preferably 50% by mass or less.

In the disclosed embodiments, the styrene-based thermoplastic elastomer is preferably a block copolymer containing at least one aromatic vinyl polymer block and at least one conjugated diene polymer block.

In the disclosed embodiments, a weight average molecular weight of the styrene-based thermoplastic elastomer is preferably from 60,000 to 350,000.

Advantageous Effects of Invention

According to the disclosed embodiments, the toner for developing electrostatic images which provides excellent balance between high temperature storage stability and low temperature fixability and which is less likely to cause the bleeding out of the release agent even in a long-term, high-temperature condition, is provided by the use of the relatively-low-molecular-weight release agent in combination with the styrene-based thermoplastic elastomer.

DESCRIPTION OF EMBODIMENTS

The toner for developing electrostatic images according to the disclosed embodiments, is a toner for developing electrostatic images, comprising:

colored resin particles comprising a binder resin, a colorant and a release agent, and an external additive, wherein the colored resin particles further comprise a styrene-based thermoplastic elastomer, and wherein a content of a fatty acid ester compound having a number average molecular weight (Mn) of 500 or more and less than 2,000 as the release agent, is from 2 parts by mass to 20 parts by mass with respect to 100 parts by mass of the binder resin.

Hereinafter, a production method of the colored resin particles of the disclosed embodiments, the colored resin particles obtained by the production method, a production method of the toner using the colored resin particles, and the toner of the disclosed embodiments, will be described in sequence.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the disclosed embodiments can be produced by employing the wet or dry method. The wet method is preferable. The suspension polymerization method is a particularly preferable wet method. When the suspension polymerization method is employed, the colored resin particles are produced by the following processes.

(A) Suspension Polymerization Method (A-1) Preparation Step of Polymerizable Monomer Composition First, a polymerizable monomer, a colorant, a styrene-based thermoplastic elastomer and a release agent, and in addition, other additives which are added if required, such as a charge control agent, are mixed to prepare a polymerizable monomer composition. For example, a media type dispersing machine is used for the mixing in preparation of the polymerizable monomer composition.

In the disclosed embodiments, the polymerizable monomer means a monomer having a polymerizable functional group, and a binder resin is made by polymerization of the polymerizable monomer. It is preferable to use a monovinyl monomer as a main component of the polymerizable monomer. Examples of the monovinyl monomer include styrene; styrene derivatives such as vinyltoluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used solely or in combination of two or more kinds. Among them, styrene, styrene derivatives, and derivatives of acrylic acid or methacrylic acid are preferable as the monovinyl monomer.

In order to improve the hot offset and storage stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to alcohol having two or more hydroxyl groups; other divinyl compounds such as N,N-divinylaniline and divinyl ether; and compounds having three or more vinyl groups. These crosslinkable polymerizable monomers can be used solely or in combination of two or more kinds.

In the disclosed embodiments, it is desirable that the content of the crosslinkable polymerizable monomer to be used is generally from 0.1 parts by mass to 5 parts by mass, and preferably from 0.3 parts by mass to 2 parts by mass, with respect to 100 parts by mass of the monovinyl monomer.

Further, when a macromonomer is used as a part of the polymerizable monomer, a good balance between the storage stability and low temperature fixability of the toner, can be obtained. The macromonomer has a polymerizable carbon-carbon unsaturated double bond at the end of the molecular chain and is a reactive oligomer or polymer which usually has a number average molecular weight of from 1,000 to 30,000. It is preferable that the macromonomer can form a polymer having a glass transition temperature (hereinafter may be referred to as "Tg") higher than that of a polymer obtained by polymerizing the monovinyl monomer. A used amount of the macromonomer is preferably from 0.03 parts by mass to 5 parts by mass, and more preferably from 0.05 parts by mass to 1 part by mass, with respect to 100 parts by mass of the monovinyl monomer.

In the disclosed embodiments, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include dyes and pigments such as copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments and dyes. The specific examples include C. I. Pigment Yellow 3, 12, 13, 14, 15, 17, 62, 65, 73, 74, 83, 93, 97, 120, 138, 155, 180, 181, 185, 186, 213 and 214, and C. I. Solvent Yellow 98.

Examples of the magenta colorant to be used include compounds including azo pigments such as monoazo pigments and disazo pigments, and condensed polycyclic pigments and dyes. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the disclosed embodiments, these colorants can be used solely or in combination of two or more kinds. The amount of the colorant is preferably in the range from 1 part by mass to 10 parts by mass, with respect to 100 parts by mass of the monovinyl monomer.

In the disclosed embodiments, the colored resin particles comprise a styrene-based thermoplastic elastomer. The "styrene-based thermoplastic elastomer" encompasses random, block and graft copolymers of styrene-based monomers with other monomers copolymerizable with the styrene-based monomers, such as monoolefin and/or diolefin, and hydrogenated products of the copolymers.

As the thermoplastic elastomer, typically, such a material can be used, that when the original volume is determined as 100% by volume, the volume can be changed up to 200% by volume at normal temperature (20° C.) by a small external force, and the volume returns to less than 130% by volume when the material is released from the external force.

From the viewpoint of preventing a hot offset phenomenon and optimizing the balance between the storage stability (blocking resistance) and low temperature fixability of the toner, a typical example of the styrene-based thermoplastic elastomer is a block copolymer containing at least one aromatic vinyl polymer block and at least one conjugated diene polymer block. However, the styrene-based thermoplastic elastomer of the disclosed embodiments is not limited to this typical example.

Hereinafter, the block copolymer will be described, which is a typical example of the styrene-based thermoplastic elastomer. The block copolymer of the disclosed embodiments is a block copolymer that contains at least one aromatic vinyl polymer block obtained by polymerizing an aromatic vinyl monomer and at least one conjugated diene polymer block obtained by polymerizing a conjugated diene monomer.

The aromatic vinyl monomer is not particularly limited, as long as it is an aromatic vinyl compound. As the aromatic vinyl monomer, examples include styrene, α-methylstyrene, 2-methylstyrene, 3-methylstyrene, 4-methylstyrene, 2-ethylstyrene, 3-ethylstyrene, 4-ethylstyrene, 2,4-diisopropylstyrene, 2,4-dimethylstyrene, 4-t-butylstyrene, 5-t-butyl-2-methylstyrene, 2-chlorostyrene, 3-chlorostyrene, 4-chlorostyrene, 4-bromostyrene, 2-methyl-4,6-dichlorostyrene, 2,4-dibromostyrene and vinylnaphthalene. Among them, styrene is preferable. In each aromatic vinyl polymer block, these aromatic vinyl monomers can be used solely or in combination of two or more kinds. When the block copolymer contains a plurality of the aromatic vinyl polymer blocks, the aromatic vinyl polymer blocks may be composed of the same aromatic vinyl monomer units or composed of aromatic vinyl monomer units different from each other.

As long as the aromatic vinyl monomer unit is a main repeating unit, the aromatic vinyl polymer block may contain a different monomer unit. As the different monomers that are applicable to the aromatic vinyl polymer block, examples include conjugated diene monomers such as 1,3-butadiene and isoprene (2-methyl-1,3-butadiene), α,β-unsaturated nitrile monomers, unsaturated carboxylic acid or acid anhydride monomers, unsaturated carboxylic acid ester monomers and non-conjugated diene monomers. In each aromatic vinyl polymer block, the content of the monomer units different from the aromatic vinyl monomer unit is preferably 20% by mass or less, more preferably 10% by mass or less, and particularly preferably substantially 0% by mass.

The conjugated diene monomer is not particularly limited, as long as it is a conjugated diene compound. As the conjugated diene monomer, examples include 1,3-butadiene, isoprene, 2,3-dimethyl-1,3-butadiene, 2-chloro-1,3-butadiene, 1,3-pentadiene and 1,3-hexadiene. Among them, 1,3-butadiene and/or isoprene is preferable, and isoprene is particularly preferable. When the conjugated diene polymer block is composed of the isoprene unit, the thus-obtained toner provides excellent balance between high temperature storage stability and low temperature fixability. In each conjugated diene polymer block, these conjugated diene monomers can be used solely or in combination of two or more kinds. When the block copolymer contains a plurality of the conjugated diene polymer blocks, the conjugated diene polymer blocks may be composed of the same conjugated diene monomer units or composed of conjugated diene monomer units different from each other. Also, part of the unsaturated bonds of each conjugated diene polymer block may be hydrogenated.

As long as the conjugated diene monomer unit is a main repeating unit, the conjugated diene polymer block may contain a different monomer unit. As the different monomers that are applicable to the conjugated diene polymer block, examples include aromatic vinyl monomers such as styrene and α-methylstyrene, α,β-unsaturated nitrile monomers, unsaturated carboxylic acid monomers, unsaturated carboxylic acid anhydride monomers, unsaturated carboxylic acid ester monomers and non-conjugated diene monomers. In each conjugated diene polymer block, the content of the monomer units different the conjugated diene monomer unit is preferably 20% by mass or less, more preferably 10% by mass or less, and particularly preferably substantially 0% by mass.

As long as the block copolymer contains at least one aromatic vinyl polymer block and at least one conjugated diene polymer block, the numbers and binding forms of the polymer blocks are not particularly limited. Examples of the block copolymer of the disclosed embodiments include the following block copolymers. In the following examples, "Ar" denotes an aromatic vinyl polymer block; "D" denotes a conjugated diene polymer block; "X" denotes the residue of a coupling agent; and "n" denotes an integer of 2 or more.

(a) An aromatic vinyl-conjugated diene block copolymer represented as Ar-D (b) An aromatic vinyl-conjugated diene-aromatic vinyl block copolymer represented as Ar-D-Ar or $(Ar\text{-}D)_n\text{-}X$ (c) A conjugated diene-aromatic vinyl-conjugated diene block copolymer represented as D-Ar-D or $(D\text{-}Ar)_n\text{-}X$ (d) An aromatic vinyl-conjugated diene-aromatic vinyl-conjugated diene block copolymer represented as Ar-D-Ar-D (e) A mixture of two or more kinds of the block copolymers (a) to (d).

However, the block copolymer of the disclosed embodiments is not limited to the block copolymers (a) to (e).

In the disclosed embodiments, the block copolymer is preferably the block copolymer (a), (b) or (e) (in this case, a mixture of the block copolymers (a) and (b)).

The content of the aromatic vinyl monomer unit with respect to the total monomer units of the block copolymer of the disclosed embodiments, is preferably 5% by mass or more and 50% by mass or less, more preferably 10% by mass or more and 40% by mass or less, still more preferably 15% by mass or more and 30% by mass or less, and particularly preferably 20% by mass or more and 27% by mass or less.

When the content is 5% by mass or more and 50% by mass or less, the affinity between the block copolymer and the below-described release agent is good, and the affinity between the block copolymer and the binder resin is also good.

The melt index (MI) of the block copolymer is not particularly limited. For example, the melt index is selected in a range of from 1 g/10 min to 1000 g/10 min, as a value measured in accordance with ASTM D-1238 (Condition G, 200° C., 5 kg).

The above-described block copolymer containing the aromatic vinyl polymer block and the conjugated diene polymer block, can be produced by a conventional method. The method for producing such a block copolymer may be the following method, for example. By the anionic living polymerization method, the polymer blocks are formed by polymerizing the aromatic vinyl monomers and by polymerizing the conjugated diene monomers; moreover, as needed, a coupling reaction of the polymer blocks is carried out by use of a coupling agent.

In the disclosed embodiments, a commercially-available block copolymer can be used. As the commercially-available block copolymer, for example, the following can be used: "QUINTAC" (: product name, manufactured by ZEON Corporation), "JSR-SIS" (: product name, manufactured by JSR), "VECTOR" (: product name, manufactured by DEXCO polymers), "ASAPRENE", "TUFPRENE" and "TUFTEC" (: product names, manufactured by Asahi Kasei Chemicals Corporation), and "SEPTON" (: product name, manufactured by Kuraray Co., Ltd.)

The content of the styrene monomer unit in the styrene-based thermoplastic elastomer is preferably 50% by mass or less, more preferably more than 5% by mass and less than 50% by mass, still more preferably more than 10% by mass and less than 40% by mass, yet more preferably more than 15% by mass and less than 30% by mass, and particularly preferably more than 20% by mass and less than 27% by mass.

When the content is 50% by mass or less, the affinity between the styrene-based thermoplastic elastomer and the below-described release agent is good, and the affinity between the styrene-based thermoplastic elastomer and the binder resin is also good.

The content of the styrene monomer unit in the styrene-based thermoplastic elastomer can be measured by a known method. For example, the content of the styrene monomer unit in the styrene-based thermoplastic elastomer can be measured by measuring the refractive index of the styrene-based thermoplastic elastomer with an Abbe's refractometer, in accordance with JIS K 7142.

The weight average molecular weight (Mw) of the styrene-based thermoplastic elastomer is not particularly limited. It is preferably from 60,000 to 350,000, and more preferably from 80,000 to 250,000.

When the weight average molecular weight (Mw) of the styrene-based thermoplastic elastomer is from 60,000 to 350,000, the toner provides excellent heat-resistant storage stability and good low temperature fixability.

The content of the styrene-based thermoplastic elastomer is preferably from 2 parts by mass to 10 parts by mass, more preferably form 2 parts by mass to 8 parts by mass, and still more preferably from 3 parts by mass to 7 parts by mass, with respect to 100 parts by mass of the binder resin.

When the content of the styrene-based thermoplastic elastomer is from 2 parts by mass to 10 parts by mass, a decrease in printing durability at normal temperature and a decrease in printing durability after being left at high temperature, are less likely to occur. When the content of the styrene-based thermoplastic elastomer is from 2 parts by mass to 10 parts by mass, the low temperature fixability of the toner is high, and it is not needed to increase the temperature of the fixing roller in printing. Accordingly, energy consumption can be reduced.

The release agent of the disclosed embodiments is the fatty acid ester compound having a number average molecular weight (Mn) of 500 or more and less than 2,000. The "fatty acid ester compound" means a product obtained by an ester reaction between a monohydric alcohol and/or a polyhydric alcohol and a saturated fatty acid and/or an unsaturated fatty acid.

As the monohydric alcohol, examples include the following: monohydric saturated aliphatic alcohols such as methanol, ethanol, 1-propanol, 2-propanol, 1-butanol, 2-butanol, 1-pentanol, 1-hexanol, octanol, 2-ethyl-1-hexanol, nonyl alcohol, lauryl alcohol, cetyl alcohol, stearyl alcohol and behenyl alcohol; monohydric unsaturated aliphatic alcohols such as allyl alcohol, methallyl alcohol, crotyl alcohol and oleyl alcohol; monohydric alicyclic alcohols such as cyclohexanol; and monohydric aromatic alcohols such as phenol, phenylmethanol (benzyl alcohol), methylphenol (cresol), p-ethylphenol, dimethylphenol (xylenol), nonylphenol, dodecylphenol, phenylphenol and naphthol.

As the polyhydric alcohol, examples include the following: dihydric saturated aliphatic alcohols such as ethylene glycol and propylene glycol; dihydric aromatic alcohols such as catechol and hydroquinone; and trihydric or higher saturated aliphatic alcohols such as glycerol, pentaerythritol, dipentaerythritol and polyglycerol. Among these monohydric and polyhydric alcohols, monohydric to tetrahydric saturated aliphatic alcohols are preferable, and behenyl alcohol and pentaerythritol are particularly preferable.

As the fatty acid that serves as a raw material for the fatty acid ester compound, a saturated fatty acid having a carbon number of from 12 to 22 and/or an unsaturated fatty acid having a carbon number of from 12 to 22 is preferably used, and a saturated fatty acid having a carbon number of from 14 to 18 and/or an unsaturated fatty acid having a carbon number of from 14 to 18 is more preferably used. Among them, the saturated fatty acids having the above carbon numbers are particularly preferable, since the fatty acid ester compound having a number average molecular weight (Mn) of 500 or more and less than 2,000 is easily obtained.

As the saturated fatty acids having the above carbon numbers, examples include, but are not limited to, lauric acid (carbon number 12), myristic acid (carbon number 14), pentadecylic acid (carbon number 15), palmitic acid (carbon number 16), margaric acid (carbon number 17), stearic acid (carbon number 18), arachidic acid (carbon number 20) and behenic acid (carbon number 22).

Among these saturated fatty acids, behenic acid (carbon number 22), stearic acid (carbon number 18) and arachidic acid (carbon number 20) are more preferable.

As the unsaturated fatty acids having the above carbon numbers, examples include, but are not limited to, the following.

Palmitoleic acid ($CH_3$ $(CH_2)_5CH{=}CH(CH_2)_7COOH$)

Oleic acid ($CH_3$ $(CH_2)_7CH{=}CH(CH_2)_7COOH$)

Vaccenic acid ($CH_3$ $(CH_2)_5CH{=}CH(CH_2)_9COOH$)

Linoleic acid ($CH_3(CH_2)_3(CH_2CH{=}CH)_2(CH_2)_7COOH$)

(9,12,15)-Linolenic acid ($CH_3(CH_2CH{=}CH)_3(CH_2)_7COOH$)

(6,9,12)-Linolenic acid ($CH_3(CH_2)_3(CH_2CH{=}CH)_3(CH_2)_4COOH$)

Eleostearic acid ($CH_3(CH_2)_3(CH{=}CH)_3(CH)_7COOH$)

Arachidonic acid ($CH_3$ $(CH)_3(CH_2CH{=}CH)_4(CH_2)_3COOH$)

The above saturated fatty acids and/or unsaturated fatty acids may be used solely or in combination of two or more kinds.

The number average molecular weight (Mn) of the fatty acid ester compound is 500 or more and less than 2,000, preferably from 500 to 1,500, and more preferably from 550 to 1,200.

When the number average molecular weight (Mn) of the fatty acid ester compound is 500 or more and less than 2,000, excellent balance between high temperature storage stability and low temperature fixability is obtained.

The above-described fatty acid ester compound can be produced by a conventional method. As the method for producing such a fatty acid ester compound, examples include a method for carrying out an ester reaction using a monohydric alcohol and/or a polyhydric alcohol and a saturated fatty acid and/or an unsaturated fatty acid.

In the disclosed embodiments, a commercially-available fatty acid ester compound can be used. As the commercially-available fatty acid ester compound, examples include "WEP2", "WEP3", "WEP4", "WEP5", "WE6" and "WE11" (: product names).

The content of the fatty acid ester compound is from 2 parts by mass to 20 parts by mass, preferably from 3 parts by mass to 15 parts by mass, and more preferably from 4 parts by mass to 10 parts by mass, with respect to 100 parts by mass of the binder resin.

When the content of the fatty acid ester compound is from 2 parts by mass to 20 parts by mass, such a toner is obtained, that has excellent low-temperature fixability, a narrow particle size distribution and a uniform particle diameter.

In the disclosed embodiments, a different release agent may be used in combination with the fatty acid ester compound. As another release agent, examples include low-molecular-weight polyolefin waxes and modified waxes thereof; natural plant waxes such as jojoba; petroleum waxes such as paraffin; mineral waxes such as ozokerite; synthetic waxes such as Fischer-Tropsch wax; and polyhydric alcohol esters such as dipentaerythritol ester. As the above different release agent, one kind of release agent or two or more kinds of release agents may be used.

As another additive, a positively or negatively chargeable charge control agent can be used to improve the chargeability of the toner.

The charge control agent is not particularly limited, as long as it is one that is generally used as a charge control agent for toners. Among charge control agents, a positively or negatively chargeable charge control resin is preferred, from the viewpoint that the charge control resin is highly compatible with the polymerizable monomer and can impart stable chargeability (charge stability) to the toner particles, and from the viewpoint of increasing the dispersibility of the colorant of the disclosed embodiments. From the viewpoint of obtaining a negatively chargeable toner, a negatively chargeable charge control resin is more preferred.

As the positively chargeable charge control agent, examples include a nigrosine dye, a quaternary ammonium salt, a triaminotriphenylmethane compound, an imidazole compound, and, as a charge control resin preferably used as the positively chargeable charge control agent, a polyamine resin, a quaternary ammonium group-containing copolymer and a quaternary ammonium salt group-containing copolymer.

As the negatively chargeable charge control agent, examples include an azo dye containing a metal such as Cr, Co, Al and Fe, a metal salicylate compound, a metal alkylsalicylate compound, and, as a charge control resin preferably used as the negatively chargeable charge control agent, a sulfonic acid group-containing copolymer, a sulfonic acid salt group-containing copolymer, a carboxylic acid group-containing copolymer and a carboxylic acid salt group-containing copolymer.

The polystyrene equivalent weight average molecular weight (Mw) of the charge control resin measured by gel permeation chromatography (GPC) using tetrahydrofuran, is in a range of from 5,000 to 30,000, preferably in a range of from 8,000 to 25,000, and more preferably in a range of from 10,000 to 20,000.

In the charge control resin, the copolymerization ratio of the monomer having a functional group such as a quaternary ammonium group and a sulfonic acid salt group, is in a range of from 0.5% by mass to 12% by mass, preferably in a range of from 1.0% by mass to 6% by mass, and more preferably in a range of from 1.5% by mass to 3% by mass.

In the disclosed embodiments, it is desirable that the charge control agent is used in an amount of generally from 0.01 parts by mass to 10 parts by mass, and preferably from 0.03 parts by mass to 8 parts by mass, with respect to 100 parts by mass of the monovinyl monomer. When the added amount of the charge control agent is from 0.01 parts by mass to 10 parts by mass, fog and soiling are less likely to occur.

Also, it is preferable to use a molecular weight modifier as the other additives, when the polymerizable monomer which becomes a binder resin is polymerized.

The molecular weight modifier is not particularly limited as long as it is generally used as a molecular weight modifier for a toner. Examples of the molecular weight modifier include mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used solely or in combination of two or more kinds.

In the disclosed embodiments, the molecular weight modifier is used in an amount of generally from 0.01 parts by mass to 10 parts by mass, and preferably from 0.1 parts by mass to 5 parts by mass, with respect to 100 parts by mass of the monovinyl monomer.

(A-2) Suspension Step to Obtain Suspension (Droplets Forming Step)

In the disclosed embodiments, the polymerizable monomer composition comprising the polymerizable monomer, the colorant, the styrene-based thermoplastic elastomer and the release agent is dispersed in an aqueous medium containing a dispersion stabilizer; a polymerization initiator is added therein; and then the droplets of the polymerizable monomer composition are formed. The method for forming the droplets is not particularly limited. The droplets are formed, for example, by means of a device capable of strong stirring, such as an in-line type emulsifying and dispersing machine (product name: MILDER, manufactured by: Pacific Machinery & Engineering Co., Ltd.) and a high-speed emulsification dispersing machine (product name: T. K. HOMOMIXER MARK II, manufactured by: PRIMIX Corporation).

Examples of the polymerization initiator include persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyisophthalate and t-butylperoxyisobutyrate. These can be used solely or in combination of two or more kinds. Among them, the organic peroxides are preferably used, since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have good initiator efficiency and can reduce residual polymerizable monomer.

The polymerization initiator may be added after dispersing the polymerizable monomer composition in the aqueous medium and before forming the droplets as described above, or it may be added to the polymerizable monomer composition before the polymerizable monomer composition is dispersed in the aqueous medium.

The added amount of the polymerization initiator used in the polymerization of the polymerizable monomer composition, is preferably from 0.1 parts by mass to 20 parts by mass, more preferably from 0.3 parts by mass to 15 parts by mass, and still more preferably from 1 part by mass to 10 parts by mass, with respect to 100 parts by mass of the monovinyl monomer.

In the disclosed embodiments, the aqueous medium means a medium containing water as a main component.

In the disclosed embodiments, the dispersion stabilizer is preferably added to the aqueous medium. Examples of the dispersion stabilizer include inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants.

These dispersion stabilizers can be used solely or in combination of two or more kinds. The added amount of the dispersion stabilizer is preferably from 0.1 parts by mass to 20 parts by mass, and more preferably from 0.2 parts by mass to 10 parts by mass, with respect to 100 parts by mass of the polymerizable monomer.

Among the above dispersion stabilizers, colloid of inorganic compounds, particularly colloid of hardly water-soluble metal hydroxide, is preferable. The use of the colloid of inorganic compounds, particularly of hardly water-soluble metal hydroxide makes it possible to narrow the particle size distribution of the colored resin particles and reduce the amount of the dispersion stabilizer remaining after washing; thus, the obtained toner becomes capable of reproducing clear images and does not deteriorate environmental stability.

(A-3) Polymerization Step

After the droplets are formed as described in the above (A-2), the obtained aqueous dispersion medium is heated to start polymerization. Thereby, an aqueous dispersion of colored resin particles containing the binder resin, the colorant, the styrene-based thermoplastic elastomer and the release agent is formed.

The polymerization temperature of the polymerizable monomer composition is preferably 50° C. or more, and more preferably from 60° C. to 95° C. The polymerization reaction time is preferably from 1 hour to 20 hours, and more preferably from 2 hours to 15 hours.

Also in this polymerization step, to polymerize the droplets of the polymerizable monomer composition while they are in a stably dispersed state, a polymerization reaction may be developed while carrying out the dispersion treatment by stirring, as with the above-described "(A-2) Suspension Step to Obtain Suspension (Droplets Forming Step)".

The colored resin particles may be used as they are as the toner, or they may be used as the toner by adding an external additive thereon. It is preferable to make the so-called core-shell type (or "capsule type") colored resin particles by using each of the above-mentioned colored resin particles as a core layer and forming a shell layer, which is different from the core layer, around the core layer. The core-shell type colored resin particles can take a balance of lowering fixing temperature and prevention of aggregation at storage, since the core layer including a substance having a low softening point is covered with a substance having a higher softening point.

A method for producing the above-mentioned core-shell type colored resin particles using the above-mentioned colored resin particles, is not particularly limited, and they can be produced by any conventional method. The in situ polymerization method and the phase separation method are preferable from the viewpoint of production efficiency.

A method for producing the core-shell type colored resin particles by the in situ polymerization method, will be hereinafter described.

A polymerizable monomer for forming a shell layer (a polymerizable monomer for shell) and a polymerization initiator are added to an aqueous medium in which the colored resin particles are dispersed, followed by polymerization, thereby the core-shell type colored resin particles can be obtained.

As the polymerizable monomer for shell, the above-mentioned polymerizable monomer can be similarly used. Among the polymerizable monomers, any monomer which provides a polymer having a Tg of more than 80° C., such as styrene, acrylonitrile and methyl methacrylate, is preferably used solely or in combination of two or more kinds.

Examples of the polymerization initiator used for polymerization of the polymerizable monomer for shell include water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)-2-hydroxyethyl) propionamide). These polymerization initiators can be used solely or in combination of two or more kinds. The amount of the polymerization initiator is preferably from 0.1 parts by mass to 30 parts by mass, and more preferably from 1 part by mass to 20 parts by mass, with respect to 100 parts by mass of the polymerizable monomer for shell.

The polymerization temperature of the shell layer is preferably 50° C. or more, and more preferably from 60° C. to 95° C. The polymerization reaction time is preferably from 1 hour to 20 hours, and more preferably from 2 hours to 15 hours.

(A-4) Steps of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying by several times as needed after the polymerization, according to any conventional method.

In the washing method, when the inorganic compound is used as the dispersion stabilizer, it is preferable that acid or alkali is added to the aqueous dispersion of the colored resin particles, thereby the dispersion stabilizer is dissolved in water and removed. When colloid of hardly water-soluble inorganic hydroxide is used as the dispersion stabilizer, it is preferable that acid is added to adjust the pH of the aqueous dispersion of the colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for its high removal efficiency and small impact on production facilities.

The methods for dehydrating and filtering are not particularly limited, and any of various known methods can be used. For example, a centrifugal filtration method, a vacuum filtration method and a pressure filtration method can be used. Also, the drying method is not particularly limited, and any of various methods can be used.

(B) Pulverization Method

In the case of producing the colored resin particles by employing the pulverization method, the following processes are performed.

First, a binder resin, a colorant, a styrene-based thermoplastic elastomer, a release agent, and other additives which are added if required (such as a charge control agent) are mixed by means of a mixer such as a ball mill, a V type mixer, FM MIXER (product name, manufactured by Nippon Coke & Engineering Co., Ltd.), a high-speed dissolver, an internal mixer and a Forberg mixer.

Next, the above-obtained mixture is kneaded while heating by means of a press kneader, a twin screw kneading machine, a roller or the like. The obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into desired particle diameters by means of a classifier such as an air classifier or an airflow classifier. Thereby, the colored resin particles produced by the pulverization method are obtained.

As the binder resin, the colorant, the styrene-based thermoplastic elastomer, the release agent and other additives which are added if required (such as the charge control agent), those used above in "(A) Suspension Polymerization Method" can be used in the pulverization method. In like manner of the colored resin particles obtained by the above-mentioned "(A) Suspension Polymerization Method", the colored resin particles obtained by the pulverization method as well can be used in any method such as the in situ polymerization method to produce the core-shell type colored resin particles.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the production method such as the above-mentioned "(A) Suspension Polymerization Method" or "(B) Pulverization Method".

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably from 3 μm to 15 μm, and more preferably from 4 μm to 12 μm. When the volume average particle diameter (Dv) is from 3 μm to 15 μm, a decrease in toner flowability, a deterioration in transferability, a decrease in image density and a decrease in image resolution are less likely to occur.

For the colored resin particles, the ratio (Dv/Dn) between the volume average particle diameter (Dv) and the number average particle diameter (Dn) is preferably from 1.0 to 1.3, and more preferably from 1.0 to 1.2. When the ratio Dv/Dn is from 1.0 to 1.3, a decrease in transferability, a decrease in image density and a decrease in resolution are less likely to occur. The volume average particle diameter and number average particle diameter of the colored resin particles can be measured by means of a particle size analyzer (product name: MULTISIZER, manufactured by: Beckman Coulter, Inc.), for example.

The average circularity of the colored resin particles of the disclosed embodiments is preferably from 0.96 to 1.00, more preferably from 0.97 to 1.00, and even more preferably from 0.98 to 1.00, from the viewpoint of image reproducibility.

When the average circularity of the colored resin particles is from 0.96 to 1.00, thin line reproducibility in printing is excellent.

The colored resin particles may be used as they are as the toner, or a mixture of carrier particles (such as ferrite and iron powder) and the colored resin particles may be used as the toner. To control the chargeability, flowability, storage stability, etc., of the toner, the colored resin particles and the external additive may be mixed to make a one-component toner, or the colored resin particles, the external additive and the carrier particles may be mixed to make a two-component developer, by means of a high-speed mixer such as HENSCHEL MIXER (product name, manufactured by Mitsui Mining Co., Ltd.)

The mixer for performing the external addition is not particularly limited, as long as it is a mixer capable of add the external additive on the surface of the colored resin particles. For example, the external addition can be performed by means of a mixing machine capable of mixing and stirring, such as FM MIXER (product name, manufactured by Nippon Coke & Engineering Co., Ltd.), SUPER MIXER (product name, manufactured by Kawata Manufacturing Co., Ltd.), Q MIXER (product name, manufactured by Nippon Coke & Engineering Co., Ltd.), MECHANOFUSION SYSTEM (product name, manufactured by Hosokawa Micron Corporation) and MECHANOMILL (product name, manufactured by Okada Seiko Co., Ltd.)

As the external additive, examples include inorganic fine particles made of silica, titanium oxide, aluminum oxide, zinc oxide, tin oxide, calcium carbonate, calcium phosphate and/or cerium oxide, and organic fine particles made of polymethyl methacrylate resin, silicone resin and/or melamine resin. Among them, inorganic fine particles are preferred. Among inorganic fine particles, silica and/or titanium oxide is preferred, and fine particles made of silica are particularly preferred.

These external additives can be used solely. It is preferable to use two or more kinds of them in combination.

In the disclosed embodiments, the amount of the external additive used is generally from 0.05 parts by mass to 6 parts by mass, and preferably from 0.2 parts by mass to 5 parts by mass, with respect to 100 parts by mass of the colored resin particles. When the added amount of the external additive is from 0.05 parts by mass to 6 parts by mass, the toner is less likely to be left untransferred, and fog is less likely to occur.

3. Toner of the Disclosed Embodiments

The toner of the disclosed embodiments obtained through the above steps is a toner which provides excellent balance between high temperature storage stability and low temperature fixability and which is less likely to cause the bleeding out of the release agent even in a long-term, high-temperature condition, since the toner contains the styrene-based thermoplastic elastomer in combination with the relatively-low-molecular-weight release agent.

EXAMPLES

Hereinafter, the toner of the disclosed embodiments will be described further in detail with reference to examples and comparative examples. However, the toner of the disclosed embodiments is not limited to these examples. Herein, "part(s)" and "%" are based on mass basis unless otherwise noted.

Test methods used in the examples and comparative examples are as follows.

1. Production of Toner

Example 1

First, 80.5 parts of styrene and 19.5 parts of n-butyl acrylate as monovinyl monomers (the calculated Tg of a copolymer obtained by copolymerizing the monomers: 55° C.), 7 parts of carbon black (product name: #25B, manufactured by: Mitsubishi Chemical Corporation) as a colorant, 0.5 parts of divinylbenzene as a crosslinkable polymerizable monomer, 1.2 parts of t-dodecyl mercaptan as a molecular weight modifier, and 0.3 parts of a polymethacrylic acid ester macromonomer (product name: AA6, manufactured by: Toagosei Co., Ltd., Tg: 94° C.) as a macromonomer, were wet-pulverized using a media-type wet pulverizer. Then, 1 part of a charge control resin (product name: ACRYBASE FCA-207P, styrene-acrylic resin manufactured by: Fujikura Kasei Co., Ltd.) as a charge control agent, 20 parts of a fatty acid ester 1 (behenyl stearate, number average molecular weight (Mn): 592) as a release agent, and 5 parts of an elastomer a (product name: QUINTAC 3270, manufactured by: ZEON Corporation, styrene monomer unit content: 24% by mass, weight average molecular weight (Mw): 106,000, MI: 20 (g/10 min)) as a styrene-based thermoplastic elastomer, were added thereto. They were mixed to obtain a polymerizable monomer composition.

Meanwhile, in a stirring tank, at room temperature, an aqueous solution in which 4.1 parts of sodium hydroxide (an alkali metal hydroxide) was dissolved in 50 parts of ion exchanged water, was gradually added under stirring to an aqueous solution in which 7.4 parts of magnesium chloride (a water-soluble polyvalent metal salt) was dissolved in 250 parts of ion exchanged water, thereby preparing a magnesium hydroxide colloidal dispersion (a hardly water-soluble metal hydroxide colloidal dispersion).

Meanwhile, 2 parts of methyl methacrylate (Tg: 105° C.) as a polymerizable monomer for shell and 65 parts of ion exchanged water were subjected to a fine dispersion treatment by means of an ultrasonic emulsifying machine, thereby obtaining an aqueous dispersion of the polymerizable monomer for shell.

For the diameter of the droplets of the polymerizable monomer for shell, D90 was 1.6 μm.

The polymerizable monomer composition was charged into the magnesium hydroxide colloidal dispersion obtained above; the mixture was stirred until droplets were stabilized; and 6 parts of t-butylperoxy isobutyrate (product name: PERBUTYL IB, manufactured by: NOF Corporation) as a polymerization initiator was added thereto. Thereafter, droplets of the polymerizable monomer composition were formed by dispersion while circulation by high shear stirring at a rotational speed of 15,000 rpm, using an in-line type emulsifying disperser (product name: MILDER, manufactured by: Pacific Machinery & Engineering Co., Ltd.)

Next, 1 part of sodium tetraborate decahydrate was added to the aqueous dispersion of the polymerizable monomer composition formed into the droplets. The aqueous dispersion was charged into a reactor furnished with a stirring blade, and the temperature thereof was raised to 85° C. to start a polymerization reaction. After a polymerization conversion reached almost 100%, the aqueous dispersion of the polymerizable monomer for shell and 0.3 parts of 2,2'-azobis (2-methyl-N-(2-hydroxyethyl)propionamide) (product name: VA-086, manufactured by: Wako Pure Chemical Industries, Ltd., water-soluble) as a polymerization initiator for shell, were added to the reactor. Thereafter, polymerization was continued for 4 hours, and then the reaction was stopped by water cooling to obtain an aqueous dispersion of colored resin particles having a core-shell structure.

The aqueous dispersion of the colored resin particles was washed with dilute sulfuric acid (25° C., 10 minutes) to obtain a pH of 4.5 or less. Next, water was separated therefrom by filtration. Then, 200 parts of ion exchanged water was added to the obtained solid to make a slurry again, and a water washing treatment (washing, filtration and dehydration) was repeatedly performed several times at room temperature (25° C.). The obtained solid was separated by filtration and then vacuum-dried to obtain dried colored resin particles.

To 100 parts of the colored resin particles obtained above, as external additives, 1 part of hydrophobized silica fine particles (number average primary particle diameter 7 nm) and 1 part of hydrophobized silica fine particles (number average primary particle diameter 35 nm) were added. The mixture was stirred and subjected to an external addition treatment to prepare the toner for developing electrostatic images of Example 1, using a high-speed mixer (product name: HENSCHEL MIXER, manufactured by: Mitsui Mining Co., Ltd.) The toner for developing electrostatic images of Example 1 was tested as described below.

Examples 2 to 8 and Comparative Examples 1 and 2

The toners of Examples 2 to 8 and Comparative Examples 1 and 2 were produced and tested in the same manner as Example 1, except that the type and/or amount of the added release agent and the type and/or amount of the added styrene-based thermoplastic elastomer were changed as shown in the following Tables 1 and 2.

The fatty acid ester 2 shown in the following Table 1 is pentaerythritol tetrastearate (number average molecular weight (Mn): 1,200).

The elastomer e shown in the following Table 1 is QUINTAC 3520 (product name, manufactured by ZEON Corporation, styrene monomer unit content: 15% by mass, MI: 7 (g/10 min)).

Comparative Example 3

A fatty acid ester 3 was synthesized as follows.

First, 100 g (0.19 mol) of polyglycerol (product name: POLYGLYCEROL #500, manufactured by: Sakamoto Yakuhin Kogyo Co., Ltd.) as polyhydric alcohol and 566 g (1.6 mol) of behenic acid (product name: NAA-222S, manufactured by: NOF Corporation) as fatty acid, were put in a four-neck flask equipped with a thermometer, a nitrogen inlet tube, a mixer and a cooling tube. Under a nitrogen flow, the mixture was reacted at normal pressure for 24 hours, while reaction water was distilled away at 220° C.

Next, 180 g of toluene and 30 g of n-propanol were put in 600 g of an esterified crude product thus obtained, and 100 g of an 8% potassium hydroxide aqueous solution was added thereto. The mixture was deacidified by mixing at 70° C. for 30 minutes. After the mixture was left to stand for 30 minutes, an aqueous phase thus formed was removed therefrom.

Next, as water washing, 20 parts of ion-exchanged water with respect to 100 parts of the esterified crude product used in the deacidification process, was added thereto. They were mixed at 70° C. for 30 minutes. After the mixture was left to stand for 30 minutes, an aqueous phase thus formed was removed therefrom. The series of water washing processes were repeated four times until the pH of the resulting effluent became neutral.

From an ester phase thus obtained, the solvent was distilled away at 180° C. and a reduced pressure of 1 kPa. Then, the resulting product was filtered to obtain the fatty acid ester 3. The number average molecular weight (Mn) of the fatty acid ester 3 was 2,450.

The toner of Comparative Example 3 was produced and tested in the same manner as Example 1, except that the type and amount of the added release agent and the type and amount of the added styrene-based thermoplastic elastomer were changed as shown in the following Table 2.

The elastomer b shown in the following Table 2 is a styrene/ethylene-ethylene-propylene/styrene-type block copolymer (product name: SEPTON 4033, manufactured by: Kuraray Co., Ltd., styrene monomer unit content: 30% by mass, weight average molecular weight (Mw): 81,000, MI: less than 0.1 (g/10 min)).

Comparative Example 4

A fatty acid ester 4 was synthesized in the same manner as the synthesis of the fatty acid ester 3 of Comparative Example 3, except that the type and amount of the added fatty acid were changed from 566 g of behenic acid to 205 g of stearic acid and 245 g of behenic acid. The number average molecular weight (Mn) of the fatty acid ester 4 was 2,200.

The toner of Comparative Example 4 was produced and tested in the same manner as Example 1, except that the type and amount of the added release agent and the type and amount of the added styrene-based thermoplastic elastomer were changed as shown in the following Table 2.

The elastomer d shown in the following Table 2 is a styrene/ethylene-propylene/styrene-type block copolymer (product name: SEPTON 2004, manufactured by: Kuraray Co., Ltd., styrene monomer unit content: 18% by mass, MI: less than 0.1 (g/10 min)).

Comparative Example 5

The toner of Comparative Example 5 was produced and tested in the same manner as Example 1, except that the type and amount of the added release agent and the type and amount of the added styrene-based thermoplastic elastomer were changed as shown in the following Table 2.

The elastomer c shown in the following Table 2 is a styrene/ethylene-propylene/styrene-type block copolymer (product name: SEPTON 2104, manufactured by: Kuraray Co., Ltd., styrene monomer unit content: 65% by mass, weight average molecular weight (Mw): 64,000, MI: less than 8 (g/10 min)). The fatty acid ester 3 shown in the following Table 2 is the same fatty acid ester as the one used in Comparative Example 3.

2. Evaluation for Properties of Fatty Acid Ester Compound and Styrene-Based Thermoplastic Elastomer.

(1) Molecular Weights (Weight Average Molecular Weight (Mw), Number Average Molecular Weight (Mn) and Molecular Weight Distribution) of Fatty Acid Ester Compound Each of the fatty acid esters 1 to 4 was dissolved in tetrahydrofuran to obtain a 0.2% by mass solution. The solution was filtered through a 0.45 μm membrane filter. A fatty acid ester compound thus obtained was used as a measurement sample and measured in the following measurement condition. The weight average molecular weight (Mw) and number average molecular weight (Mn) of the fatty acid ester compound were polystyrene equivalent molecular weights.

<Measurement Condition>

Measurement device: HLC-8220GPC (manufactured by Tosoh Corporation)

Columns: Two Shodex GPC KF-402HQ columns (manufactured by Showa Denko K. K.)

Eluent: Tetrahydrofuran (THF)

Elution rate: 0.3 mL/min

Detector: RI (polarity (+))

Column temperature: 40° C.

Injected amount: 20 μL (2) Melt Index (MI) of Styrene-Based Thermoplastic Elastomer The melt index (MI) of each of the elastomers a to d was measured in accordance with ASTM D-1238 (Condition G, 200° C., 5 kg).

3. Evaluation of Toner, Etc.

The toners of Examples 1 to 8 and Comparative Examples 1 to 5 and the colored resin particles used in each of the toners were evaluated. The details are as follows.

(1) Evaluation of Colored Resin Particles a. Volume Average Particle Diameter (Dv), Number Average Particle Diameter (Dn) and Particle Size Distribution (Dv/Dn)

About 0.1 g of the colored resin particles were weighed out and put in a beaker. Next, as a dispersant, 0.1 mL of a surfactant aqueous solution (product name: DRIWEL, manufactured by: Fujifilm Corporation) was added thereto. In addition, 10 mL to 30 mL of ISOTON II was put in the beaker. The mixture was dispersed for 3 minutes with a 20 W ultrasonic disperser. Then, the volume average particle diameter (Dv) and number average particle diameter (Dn) of the colored resin particles were measured with a particle diameter measuring device (product name: MULTISIZER, manufactured by: Beckman Coulter, Inc.) in the following condition. Also, the particle size distribution (Dv/Dn) was calculated.

Aperture diameter: 100 μm

Medium: ISOTON II

Number of measured particles: 100,000 particles b. Average Circularity

First, 10 mL of ion-exchanged water was put in a container. Then, as a dispersant, 0.02 g of a surfactant was added thereto. In addition, 0.02 g of the colored resin particles were added thereto. The mixture was subjected to a dispersion treatment for 3 minutes with an ultrasonic disperser at 60 W. The concentration of the colored resin particles was adjusted so as to be from 3,000 to 10,000 particles/μL when measuring. Of the colored resin particles, 1,000 to 10,000 particles having an equivalent circle diameter of 0.4 μm or more were measured with a flow particle image analyzer (product name: FPIA-2100, manufactured by: Sysmex Corporation). From the measured values, the average circularity was obtained.

Circularity is represented by the following calculation formula 1. The average circularity is the average of the calculated circularity values.

Calculation Formula 1

(Circularity)=(Perimeter of a circle having the same area as the projected area of a particle image)/(Perimeter of the projected particle image)

(2) Toner Evaluation a. Measurement of SEM Bleeding Rate

First, each toner was stored for one month in an environment at a temperature of 45° C. and a humidity of 80% and prepared as a stored toner.

The stored toner was subjected to SEM observation. At 2,000-fold magnification, 10 images of the toner were taken. Next, for each toner image, the number (A) of all toner particles shown in the image and the number (B) of toner particles on each of which the release agent bled out, were measured. Then, for each toner image, the toner particle number (B) was divided by the toner particle number (A). The resultant was multiplied by 100 to obtain a value. The average of the values calculated for the 10 toner images was determined as the SEM bleeding rate (%) of the toner.

b. Evaluation for Printing Durability of Stored Toner

In a printing durability test, a commercially available non-magnetic one-component development printer (print speed: 40 A4 sheets/min) was used. The toner cartridge of the development device was filled with a stored toner. Then, printing sheets were set in the printer.

First, each toner was stored for one month in an environment at a temperature of 45° C. and a humidity of 80% and prepared as the stored toner.

The stored toner was left to stand in a high temperature and high humidity (H/H) environment (temperature: 32.5° C., humidity: 80%) for 24 hours. Then, using the toner, continuous printing was performed up to 20,000 sheets at a printing density of 5% in the same environment.

Black solid pattern printing (100% printing density) was performed every 500 sheets, and the printing density of the black solid pattern was measured using a reflection image densitometer (product name: RD918, manufactured by: Macbeth). Further, after that, white solid pattern printing (0% printing density) was performed. The printer was stopped in the middle of the white solid pattern printing. Then, the toner in a non-image area on a photoconductor after development was adhered to an adhesive tape (product name: SCOTCH MENDING TAPE 810-3-18, manufactured by: Sumitomo 3M Limited). The adhesive tape was peeled off and attached to a printing sheet. Next, the whiteness degree (B) of the printing sheet on which the adhesive tape had been attached was measured using a whiteness meter (product name: ND-1, manufactured by: Nippon Denshoku Industries Co., Ltd.) Similarly, only an unused adhesive tape was attached on the printing sheet to measure the whiteness degree (A) thereof, and a difference (B−A) between these whiteness degrees was taken as a fog value (%). The smaller value indicates that fog is less, and image quality is better.

The number of continuous printed sheets that could maintain an image quality with a printing density of 1.3% or more and a fog value of 3% or less, was examined.

In the following Table 1, ">20000" indicates that the image quality with a printing density of 1.3% or more and a fog value of 3% or less could be maintained even on the 20,000th printed sheet.

c. Minimum Fixing Temperature

A fixing test was performed using a commercially available non-magnetic one-component development printer, which was modified so that the temperature of the fixing roller could be changed.

In the fixing test, a black solid pattern (100% printing density) was printed; the temperature of the fixing roller of the modified printer was changed by 5° C., and the toner fixing rate at each changed temperature was measured; and the relationship between the temperature and the fixing rate was obtained.

A tape peeling operation was performed in the black solid pattern-printed area (100% printing density). The fixing rate was calculated from a ratio of image densities before and after the tape peeling operation. That is, given that the image density before the tape peeling operation is defined as ID (before) and the image density after the tape peeling operation is defined as ID (after), the fixing rate can be calculated from the following Calculation Formula 2.

Calculation Formula 2:

$$\text{Fixing rate (\%)}=(\text{ID(after)}/\text{ID(before)})\times 100$$

Here, the tape peeling operation means a series of operations including: attaching an adhesive tape (product name:

SCOTCH MENDING TAPE 810-3-18, manufactured by: Sumitomo 3M Limited) to a measuring part of a test paper, pressing the adhesive tape at a constant pressure to be adhered, and then peeling off the adhesive tape in a direction along the paper at a constant speed. Moreover, the image density was measured using a reflection image densitometer (product name: RD914, manufactured by: Macbeth).

In this fixing test, the minimum fixing roller temperature at which the fixing rate was more than 80%, was defined as the minimum fixing temperature of the toner.

d. Evaluation for Storage Stability

First, 10 g of each toner was put in a 100 mL polyethylene container, and the container was hermetically sealed. Then, the container was submerged in a constant temperature water bath kept at a predetermined temperature and taken out after a lapse of 8 hours. From the container taken out, the toner was transferred onto a 42-mesh sieve so as not to be vibrated as much as possible, and set in a powder characteristic tester (product name: POWDER TESTER PT-R, manufactured by: Hosokawa Micron Corporation). The amplitude of the sieve was set to 1.0 mm, and the sieve was vibrated for 30 seconds. Then, the mass of the toner remaining on the sieve was measured, and this was defined as the mass of the aggregated toner.

The maximum temperature (° C.) at which the mass of the aggregated toner was 0.5 g or less was defined as the index of storage stability.

Tables 1 and 2 show the evaluation results of the toners of Examples 1 to 8 and Comparative Examples 1 to 5, along with the information on the release agents and styrene-based thermoplastic elastomers used.

TABLE 1

| | | Example 1 | Example 2 | Example 3 | Example 4 | Example 5 |
|---|---|---|---|---|---|---|
| Release agent | Type | Fatty acid ester 1 | Fatty acid ester 1 | Fatty acid ester 2 | Fatty acid ester 2 | Fatty acid ester 2 |
| | Content (parts) | 20 | 20 | 20 | 20 | 20 |
| | Number average molecular weight (Mn) | 592 | 592 | 1200 | 1200 | 1200 |
| Styrene-based thermoplastic elastomer | Type | Elastomer a | Elastomer a | Elastomer a | Elastomer a | Elastomer a |
| | Content (parts) | 5 | 10 | 2 | 5 | 8 |
| | Styrene monomer unit content (%) | 24 | 24 | 24 | 24 | 24 |
| Toner evaluation | SEM bleeding rate (%) | 1 | 4 | 2 | 7 | 5 |
| | Printing durability (sheets) of stored toner | >20000 | >20000 | >20000 | >20000 | >20000 |
| | Minimum fixing temperature (° C.) | 125 | 125 | 145 | 145 | 145 |
| | Storage stability evaluation temperature (° C.) | 57 | 57 | 58 | 58 | 58 |

| | | Example 6 | Example 7 | Example 8 |
|---|---|---|---|---|
| Release agent | Type | Fatty acid ester 1 | Fatty acid ester 1 | Fatty acid ester 2 |
| | Content (parts) | 20 | 3 | 20 |
| | Number average molecular weight (Mn) | 592 | 592 | 1200 |
| Styrene-based thermoplastic elastomer | Type | Elastomer e | Elastomer a | Elastomer e |
| | Content (parts) | 5 | 5 | 5 |
| | Styrene monomer unit content (%) | 15 | 24 | 15 |
| Toner evaluation | SEM bleeding rate (%) | 2 | 1 | 2 |
| | Printing durability (sheets) of stored toner | >20000 | >20000 | >20000 |
| | Minimum fixing temperature (° C.) | 125 | 130 | 145 |
| | Storage stability evaluation temperature (° C.) | 58 | 57 | 58 |

TABLE 2

| | | Comparative Example 1 | Comparative Example 2 | Comparative Example 3 | Comparative Example 4 | Comparative Example 5 |
|---|---|---|---|---|---|---|
| Release agent | Type | Fatty acid ester 1 | Fatty acid ester 2 | Fatty acid ester 3 | Fatty acid ester 4 | Fatty acid ester 3 |
| | Content (parts) | 20 | 20 | 5 | 5 | 5 |
| | Number average molecular weight (Mn) | 592 | 1200 | 2450 | 2200 | 2450 |
| Styrene-based thermoplastic elastomer | Type | — | — | Elastomer b | Elastomer d | Elastomer c |
| | Content (parts) | — | — | 5 | 3 | 5 |
| | Styrene monomer unit content (%) | — | — | 30 | 18 | 65 |
| Toner evaluation | SEM bleeding rate (%) | 18 | 27 | 14 | 20 | 19 |
| | Printing durability (sheets) of stored toner | 10000 | 8000 | 12000 | 12000 | 12000 |
| | Minimum fixing temperature (° C.) | 125 | 130 | 160 | 160 | 180 |
| | Storage stability evaluation temperature (° C.) | 56 | 58 | 55 | 55 | 55 |

4. Consideration

Hereinafter, the toner evaluation results will be studied with reference to Tables 1 and 2.

According to Table 2, the toners of Comparative Examples 1 and 2 are toners not containing a styrene-based thermoplastic elastomer.

For each of the toners of Comparative Examples 1 and 2, Table 2 shows that the SEM bleeding rate is 18% or more and high, and the evaluation result of the printing durability of the stored toner is 10,000 sheets or less and small. For the toner of Comparative Example 1, the storage stability evaluation temperature is 56° C. and low.

Accordingly, for the toners of Comparative Examples 1 and 2, which are toners not containing a styrene-based thermoplastic elastomer, it was revealed that the bleeding out of release agents is likely to be caused in a long-term, high-temperature condition.

According to Table 2, the toners of Comparative Examples 3 to 5 are toners each containing the fatty acid ester compound having a number average molecular weight (Mn) of 2,200 or more.

For each of the toners of Comparative Examples 3 to 5, Table 2 shows that the SEM bleeding rate is 14% or more and high, and the evaluation result of the printing durability of the stored toner, is 12,000 sheets and small. Also, for each of the toners of Comparative Examples 3 to 5, while the minimum fixing temperature is 160° C. and high, the storage stability evaluation temperature is 55° C. and low.

Accordingly, for the toners of Comparative Examples 3 to 5 each containing the fatty acid ester having a number average molecular weight (Mn) of 2,200 or more, it was revealed that the toners provide poor balance between high temperature storage stability and low temperature fixability, and the bleeding out of the release agent is likely to be caused in a long-term, high-temperature condition.

According to Table 1, the toners of Examples 1 to 8 are toners each containing the elastomer a or e as the styrene-based thermoplastic elastomer and the fatty acid ester 1 or 2 as the release agent. The number average molecular weight (Mn) of the fatty acid ester 1 is 592, and the number average molecular weight (Mn) of the fatty acid ester 2 is 1,200. In the toners of Examples 1 to 8, the content of the fatty acid ester 1 or 2 is from 3 parts by mass to 20 parts by mass, with respect to 100 parts by mass of the binder resin.

For each of the toners of Examples 1 to 8, Table 1 shows that the SEM bleeding rate is 7% or less and low, and the evaluation result of the printing durability of the stored toner, is more than 20,000 sheets. Also, for each of the toners of Examples 1 to 8, while the minimum fixing temperature is 145° C. or less and low, the storage stability evaluation temperature is 57° C. or more and high.

Accordingly, the toners of Examples 1 to 8, in each of which the colored resin particles contain the styrene-based thermoplastic elastomer and, as the release agent, the fatty acid ester compound having a number average molecular weight (Mn) of 500 or more and less than 2,000 and the content of the fatty acid ester compound is from 2 parts by mass to 20 parts by mass with respect to 100 parts by mass of the binder resin, are toners which provide excellent balance between high temperature storage stability and low temperature fixability and which are less likely to cause the bleeding out of the release agent even in a long-term, high-temperature condition.

The invention claimed is:

1. A toner for developing electrostatic images, comprising:

colored resin particles comprising a binder resin, a colorant and a release agent, and an external additive, wherein the colored resin particles further comprise a styrene-based thermoplastic elastomer, wherein a content of a fatty acid ester compound having a number average molecular weight (Mn) of 500 or more and less than 2,000 as the release agent, is from 2 parts by mass to 20 parts by mass with respect to 100 parts by mass of the binder resin, and wherein a weight average molecular weight of the styrene-based thermoplastic elastomer is from 60,000 to 350,000, and wherein a content of an aromatic vinyl monomer unit contained in the styrene-based thermoplastic elastomer is 15% by mass or more and less than 27% by mass.

2. The toner for developing electrostatic images according to claim 1, a content of the styrene-based thermoplastic elastomer is from 2 parts by mass to 10 parts by mass with respect to 100 parts by mass of the binder resin.

3. The toner for developing electrostatic images according to claim 1, wherein the styrene-based thermoplastic elastomer is a block copolymer containing at least one aromatic vinyl polymer block and at least one conjugated diene polymer block.

4. The toner for developing electrostatic images according to claim 1, wherein a weight average molecular weight of the styrene-based thermoplastic elastomer is from 106,000 to 350,000.

5. The toner for developing electrostatic images according to claim 1, wherein the styrene-based thermoplastic elastomer is a block copolymer containing at least one aromatic vinyl polymer block and at least one conjugated diene polymer block, and the conjugated diene polymer block is composed of an isoprene unit.

* * * * *